US007588620B2

(12) United States Patent
Tanibuchi

(10) Patent No.: US 7,588,620 B2
(45) Date of Patent: Sep. 15, 2009

(54) CUTTING TOOL

(75) Inventor: Takahito Tanibuchi, Satsumasendai (JP)

(73) Assignee: Kyocera Corporation, Kyoto (JP)

( * ) Notice: Subject to any disclaimer, the term of this patent is extended or adjusted under 35 U.S.C. 154(b) by 413 days.

(21) Appl. No.: 11/691,370

(22) Filed: Mar. 26, 2007

(65) Prior Publication Data

US 2007/0227298 A1 Oct. 4, 2007

(30) Foreign Application Priority Data

Mar. 28, 2006 (JP) ..... 2006-087806

(51) Int. Cl.
*B23P 15/28* (2006.01)
*C22C 29/00* (2006.01)

(52) U.S. Cl. ..... 75/236; 75/238; 75/239; 75/240; 75/241; 51/307; 407/119

(58) Field of Classification Search ..... 75/236, 75/238, 239, 240, 241; 51/307; 407/119
See application file for complete search history.

(56) References Cited

U.S. PATENT DOCUMENTS

| | | | | |
|---|---|---|---|---|
| 4,843,039 | A | 6/1989 | Akesson et al. | |
| 5,503,925 | A | 4/1996 | Nakano et al. | |
| 6,299,992 | B1 * | 10/2001 | Lindskog et al. | 428/697 |
| 2003/0129456 | A1 | 7/2003 | Usami et al. | |
| 2005/0014030 | A1 | 1/2005 | Usami et al. | |
| 2006/0134466 | A1 * | 6/2006 | Aoki | 428/698 |

FOREIGN PATENT DOCUMENTS

| | | | |
|---|---|---|---|
| DE | 3121903 | A1 | 12/1982 |
| JP | 04-293749 | | 10/1992 |
| JP | 04293749 | A | 10/1992 |
| JP | 11-036022 | | 2/1999 |
| JP | 11-335769 | | 12/1999 |
| JP | 11335769 | A | 12/1999 |

OTHER PUBLICATIONS

European search report for corresponding European application No. 07006373.0-2122 lists the references above.

* cited by examiner

*Primary Examiner*—Roy King
*Assistant Examiner*—Ngoclan T Mai
(74) *Attorney, Agent, or Firm*—Hogan & Hartson LLP

(57) ABSTRACT

A cutting tool comprised of a cemented carbide is provided. The cemented carbide is consisted of a composition including: a predetermined amount of at least one selected from specific carbide, nitride, and carbon nitride, except for cobalt and niobium; 0.01 to 0.08 mass % of oxygen; and the rest consisted of tungsten carbide and unavoidable impurities. The cemented carbide is further made up of a structure in which a tungsten carbide phase and a B1-type solid solution phase being expressed by M(CNO) or M(CO) where "M" is at least one selected from the group consisting of metals of the group IV, V, and VI in the periodic table, containing niobium as being essential, and containing oxygen at a rate of 1 to 4 atomic % are bound by a binder phase composed mainly of the cobalt. This achieves the cutting tool having a long tool life in high-speed interrupted cutting.

4 Claims, 2 Drawing Sheets

CUTTING TOOL

Priority is claimed to Japanese Patent Application No. 2006-87806 filed on Mar. 28, 2006, the disclosure of which is incorporated by reference in its entirety.

BACKGROUND OF THE INVENTION

1. Field of the Invention

The present invention relates to a cutting tool and, in particular, a cutting tool comprising a cemented carbide which has excellent plastic deformation resistance, high strength, and excellent wear resistance.

2. Description of Related Art

As the cemented carbide conventionally used widely for cutting of metals, there is known, for example, a WC—Co alloy made up of a hard phase composed mainly of WC (tungsten carbide), and a binder phase composed of an iron family metal such as Co (cobalt), or the system in which a solid solution phase such as carbide, nitride, carbon nitride, or the like of metals of the groups IV, V, and VI in the periodic table is dispersed in the above-mentioned WC—Co alloy. These cemented carbides are mainly used for cutting of carbon steel, alloy steel, or the like.

In recent years, forgings of further complicated shape have been often used because of the improved forging technique and the rapid advancement of near net shaping of work material. The work material having the complicated shape often include an interrupted cutting part. Additionally, high efficient cutting is required and high speed cutting is advanced in order to reduce machining costs. Hence, there is the need for a cutting tool that can allow for high-speed and strong interrupted cutting.

For example, Japanese Unexamined Patent Publication No. 4-293749 discloses a cemented carbide consisting of 4 to 20 weight % of Co, 0.2 to 20 weight % of carbide of transition metals of the groups IV, V, and VI in the periodic table, except for W (tungsten), WC, and unavoidable impurities. There is also disclosed that the fracture resistance in interrupted cutting and the wear resistance in continuous cutting can be improved by reducing the nitrogen content of the cemented carbide to 0.005 to 0.200 weight %, and reducing the oxygen content to 0.001 to 0.200 weight %.

In the cemented carbide obtained by simply reducing oxygen amount and nitrogen amount in the entire sintered body, as in the case with the above publication, transverse rupture force can be improved thereby to improve the fracture resistance when used for interrupted cutting and the wear resistance when used for continuous cutting. However, its plastic deformation resistance is insufficient for cutting such as high-speed interrupted cutting where a cutting edge is heated and subjected to a strong impact. Therefore, the cutting edge will be deformed, so that cutting accuracy is lowered and the cutting surface is rough.

Japanese Unexamined Patent Publication No. 11-36022 discloses the method of sintering by adding, as raw material powder for manufacturing a cemented carbide containing a plate crystal WC, a tungsten powder, a binder phase consisted powder of such as cobalt or the like, a carbon powder, and an oxygen-containing compound powder composed of at least one of oxide, carboxide, nitroxide, oxycarbonitride of metals of the groups IV, V, and VI in the periodic table, and solid solution of these. In accordance with this method, the oxygen-containing compound powder in the raw material is firstly reacted with carbon, thereby generating carbon oxide. When this is heated, the oxygen of the carbon oxide is gradually reacted with carbon and changed to carbide. On the other hand, the tungsten powder consists a complex carbide together with carbon and cobalt or nickel, and the complex carbide exists stably up to high temperature because the above-mentioned oxygen-containing compound consumes carbon, and hence no carbon is supplied thereto. There is disclosed that a large amount of plate crystal WC having a high aspect ratio are deposited from a large amount of the complex carbide.

In the cemented carbide wherein the plate crystal WC is allowed to deposit by adding the oxygen-containing compound powder into the raw material powder, as in the above publication, hardness and strength can be improved at the same time by the presence of the plate crystal WC. However, the oxygen amount remaining at a B1-type solid solution phase in the sintered body cannot be controlled, so that a large amount of oxygen remain and the hardness and strength of the B1-type solid solution phase are lowered. These are insufficient for satisfying the plastic deformation resistance required for high-speed interrupted cutting.

Japanese Unexamined Patent Publication No. 11-335769 discloses the method of manufacturing a cemented carbide by using, as raw material powders, a tungsten carbide powder (raw material A) having a particle size of 0.6 to 1 μm, a tungsten carbide powder (raw material B) whose particle size is not less than two times that of the raw material A, a binder phase consisted metal powder (raw material C) such as metal cobalt, and at least one of carbide, nitride, oxide (except for tungsten carbide) powder (raw material D) selected from elements of the groups IV, V, and VI in the periodic table, or a solid solution phase of these, having a mean particle size of 0.01 to 0.5 μm. There is disclosed that when forming and sintering are carried out by adding a raw material powder containing oxygen as being essential for the raw material D, it is possible to make plate WC particles containing, in the interior of crystal particles thereof, a compound composed of at least one of oxide, carboxide, nitroxide, and oxycarbonitride selected from elements of the groups IV, V, and VI in the periodic table, or a solid solution phase of these.

In the cemented carbide containing the compound particles containing oxygen in the interior of the plate WC, as in the case with the above publication, strain occurs in the crystal particles of the plate WC, and the strain enhances the WC crystal particles thereby to minimize variations in the strength of the cemented carbide, leading to excellent hardness and strength. However, only the enhancement of the WC crystal particles is insufficient to suppress the progress of cracks in high-speed interrupted cutting. That is, in the high-speed interrupted cutting where the cutting edge is heated, for example, in the cases where complicated-shaped forgings made of carbon steel or alloy steel, such as a knuckle and a pinion gear, are cut interruptedly at high speed, it cannot be said that the plastic deformation resistance suffices for the cutting. Therefore, in the high-speed interrupted cutting where the cutting edge is heated and subjected to a impact, the cutting edge causes plastic deformation, and the plastic deformation leads to anomalous wear and film peeling, resulting in a short tool life.

SUMMARY OF THE INVENTION

The present invention provides a long tool life cutting tool capable of suppressing plastic deformation due to high-speed interrupted cutting, thereby exhibiting excellent wear resistance and fracture resistance.

To overcome the above problem, the present invention has significant characteristic features that the oxygen content in a cemented carbide is controlled to 0.01 to 0.08 mass %; and that, with regard to a so-called B1-type solid solution phase existing, as hard particles, together with tungsten carbide particles, a predetermined amount of oxygen is contained so as to be expressed by M(CNO) or M (CO) where "M" is at least one selected from the group consisting of metals of the group IV, V, and VI in the periodic table, containing niobium as being essential, and so as to contain oxygen at a rate of 1 to 4 atomic %.

The B1-type solid solution phase has generally higher hardness and higher strength than a tungsten carbide phase. A predetermined amount of oxygen atoms contained in the B1-type solid solution phase can exert strain on the crystal of the B1-type solid solution phase, thereby further increasing the hardness and strength of the B1-type solid solution phase. Consequently, under the conditions where a cutting edge is heated and subjected to a strong impact as in the case with high-speed interrupted cutting, the progress of cracks observed in brittle fracture originating from the cutting edge can be inhibited effectively. In addition, since the amount of oxygen contained in the entire cemented carbide is as low as 0.01 to 0.08 mass %, the tungsten carbide phase and the binder phase also have high hardness and high strength, enabling the cemented carbide to exhibit excellent plastic deformation resistance even at high temperature.

As the result, when this cemented carbide is used as a cutting tool to cut a complicated-shaped forging of carbon steel or alloy steel, such as a knuckle and a pinion gear, the plastic deformation of the cutting edge under the impact at high temperature can be inhibited thereby to suppress the shear drop and film peeling in the cutting edge.

Specifically, the cutting tool of the present invention comprising a cemented carbide. The cemented carbide is consisted of a composition including 5.0 to 15.0 mass % of cobalt, 0.8 to 4.5 mass % of niobium in terms of carbide, 0.5 to 16.0 mass % of at least one selected fromcarbide (except fortungsten carbide), nitride, and carbon nitride which are selected from the group consisting of metals of the groups IV, V, and VI in the periodic table, except for niobium, 0.01 to 0.08 mass % of oxygen, and the rest consisted of tungsten carbide and unavoidable impurities. The cemented carbide comprising a structure in Which a tungsten carbide phase and a B1-type solid solution phase being expressed by M(CNO) or M(CO) where "M" is at least one selected from the group consisting of metals of the group IV, V, and VI in the periodic table, containing niobium as being essential, and containing oxygen at a rate of 1 to 4 atomic % are bound by a binder phase composed mainly of the cobalt.

In the cemented carbide of the present invention, the transverse rupture force of the alloy can be improved by controlling the oxygen content in the cemented carbide to 0.01 to 0.08 mass %. The composition of the B1-type solid solution phase can be expressed by M(CNO) or M(CO) where "M" is the same as described above, and contain oxygen in a trace quantity, namely 1 to 4 atomic %. This enables strain to be exerted on the crystal lattice of the B1-type solid solution phase, thereby further enhancing the hardness and strength of the B1-type solid solution phase than the tungsten carbide phase. Even when a large impact is exerted on the cutting edge during cutting, so that the tungsten carbide phase in the cemented carbide might cause transgranular fracture and the cracks originating from the fracture might be progressed so as to cause plastic deformation of the cemented carbide, the B1-type solid solution phase of high strength can suppress the propagation of the cracks thereby to suppress the deformation of the cemented carbide. This improves the plastic deformation resistance of the cemented carbide. Consequently, even under severe cutting conditions where a impact is exerted in the high load state during high-speed and strong interrupted cutting, the cutting edge is free from plastic deformation. Therefore, the cutting edge has no shear drop, enabling excellent cutting.

The niobium contained in the B1-type solid solution phase is the composition enabling fine control of the amount of oxygen. For example, the oxygen content in the B1-type solid solution phase can be adjusted by using a niobium carbide powder having its surface a predetermined amount of adsorption oxygen. The niobium also has the effect of improving plastic deformation resistance.

Preferably, the B1-type solid solution phase is present at a rate of 10 to 40 area % in a visual field region of 30d×30d, where "d" is a mean particle size of the above tungsten carbide phase in the structure observation of the above cemented carbide.

Therefore, if a large impact is exerted on the cemented carbide and the tungsten carbide phase is fractured to facilitate cracks, the B1-type solid solution phase can suppress most efficiently the propagation of the cracks thereby to improve plastic deformation resistance.

That is, if the tungsten carbide phase might cause transgranular fracture and the cracks originating from the fracture might be progressed so as to cause plastic deformation of the cemented carbide, the effect of suppressing the cracks by the B1-type solid solution phase can be enhanced when the ratio of the content of the B1-type solid solution phase to the cemented carbide is 10 area % or more. When the ratio of the content of the B1-type solid solution phase to the cemented carbide is 40 area % or below, a lowering of strength can be inhibited with no drop in strength, resulting in the cemented carbide having excellent plastic deformation resistance and strength.

The B1-type solid solution phase contains at least niobium (Nb) and tantalum (Ta), and has a cored structure in which the outer periphery of a core member having a Nb/Ta of 3.0 to 8.0 is surrounded by a shell member having a Nb/Ta of 0 to 2.5, where Nb/Ta is the ratio of niobium (Nb) to tantalum (Ta). This further improves the plastic deformation resistance of a cutting tool and enhances its wear resistance and fracture resistance.

In this structure, the outer periphery of the core member containing much niobium and having superior high-temperature hardness is covered with the shell member containing much tantalum and having superior oxidation resistance. Therefore, even when the cutting edge is heated during cutting, the shell member having superior oxidation resistance can prevent oxidation of the B1-type solid solution phase and suppress deterioration of the core member having superior high-temperature hardness. This further improves the plastic deformation resistance at high temperature of the B1-type solid solution phase.

A method of manufacturing a cutting piece according to the present invention includes the step of bringing a cutting edge formed at a cross-ridge portion of a rake face and a flank face in the above-mentioned cutting tool, into contact with a surface of a work material; the step of cutting the work material by rotating either the cutting edge or the work material; and the step of separating the cutting edge from the surface of the work material. This provides stably the cutting piece having a good cutting surface.

DETAILED DESCRIPTION OF PREFERRED EMBODIMENTS

<Cutting Tool>

Figure 1:
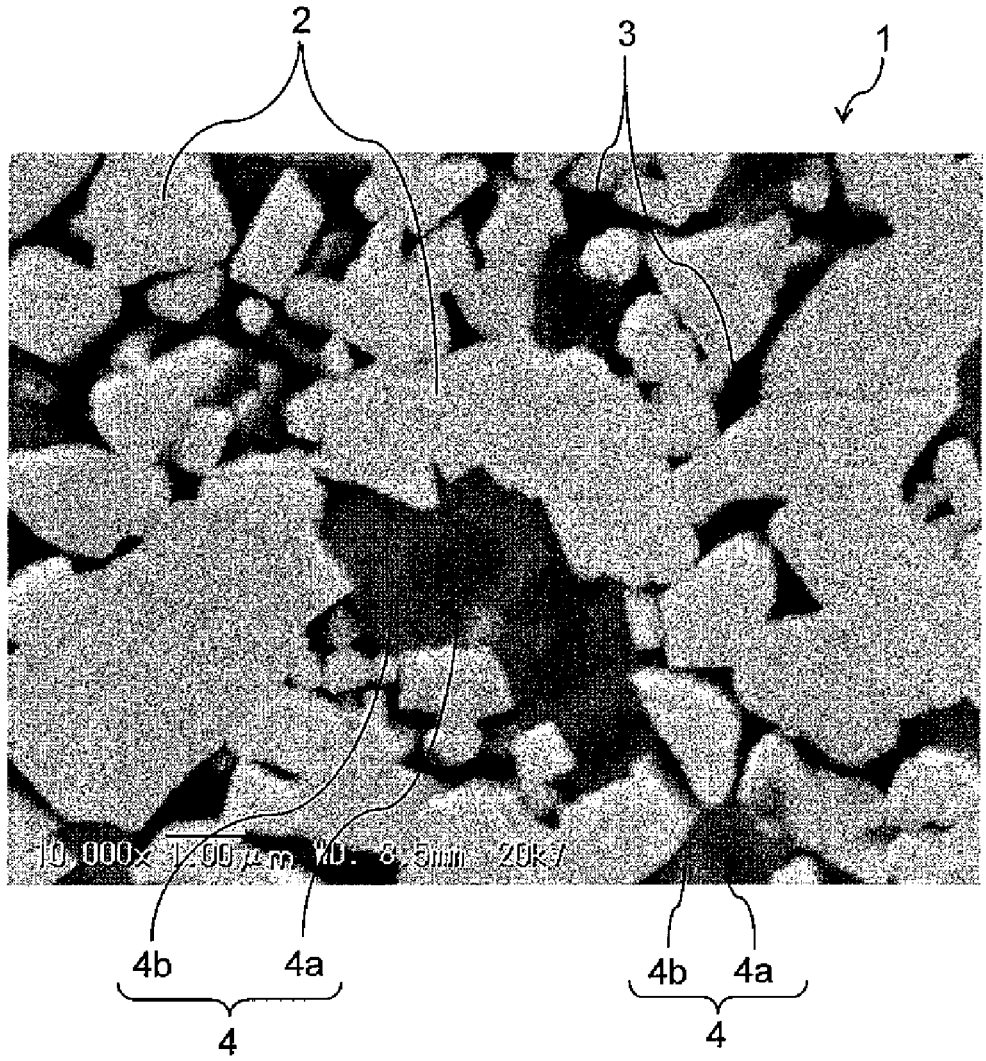
FIG. 1 is a scanning electron microscope (SEM) photograph showing a polished mirror plane in a cross section of a cemented carbide comprising a cutting tool according to a preferred embodiment of the present invention.

A preferred embodiment of a cutting tool according to the present invention will be described in detail with reference to the accompanying drawings. FIG. 1 is a scanning electron microscope (SEM) photograph showing a polished mirror plane in a cross section of a cemented carbide comprised a cutting tool according to the present embodiment.

As shown in FIG. 1, the cutting tool of the present embodiment is comprised of a cemented carbide 1 made up of a tungsten carbide phase 2, a binder phase 3, and a B1-type solid solution phase 4. The cemented carbide 1 is consisted of a composition including 5.0 to 15.0 mass % of cobalt, 0.8 to 4.5 mass % of niobium in terms of carbide, 0.5 to 16.0 mass % of at least one selected from carbide (except for tungsten carbide), nitride, and carbon nitride which are selected from the group consisting of metals of the groups IV, V, and VI in the periodic table, except for niobium, 0.01 to 0.08 mass % of oxygen, and the rest consisted of tungsten carbide and unavoidable impurities. Examples of the metals of the groups IV, V, and VI in the periodic table are Ti, Zr, Hf, V, Nb, Ta, Cr, Mo, and W.

The cemented carbide 1 is further consisted of a structure in which a tungsten carbide phase and a B1-type solid solution phase being expressed by M(CNO) or M(CO) where "M" is the same as described above, and containing oxygen at a rate of 1 to 4 atomic %, are bound by a binder phase composed mainlyof the cobalt.

In accordance with the present embodiment, there are significant characteristic features that the oxygen content in the cemented carbide 1 is 0.01 to 0.08 mass %; and that the B1-type solid solution phase 4 has a composition being expressed by M(CNO) or M (CO) where "M" is the same as described above, and containing oxygen at a rate of 1 to 4 atomic %.

Specifically, strain can be exerted on the crystal of the B1-type solid solution phase 4 by having the B1-type solid solution phase 4 contain oxygen having a smaller covalent radius than carbon or nitrogen, at a rate of 1 to 4 atomic %. When a predetermined amount of oxygen is solid-dissolved in the B1-type sold solution phase 4 composed basically of a crystal structure of carbide or nitrogen carbide, the covalent radius of carbon is 0.077 nm, the covalent radius of nitrogen is 0.075 nm, and the covalent radius of oxygen is 0.072 nm, namely, the bond radius around oxygen atoms is smaller than the bond radius of carbon or nitrogen atoms. This makes it possible to exert strain on the crystal of the carbide or nitrogen carbide structure. As the result, strain energy can be stored in the interior of the B1-type solid solution phase 4. In the cases where cracks occur by a impact exerted at high temperature in the tungsten carbide phase 2 having a lower hardness than the B1-type solid solution phase 4, and dislocation is likely to occur when the cracks strike against the B1-type solid solution phase 4, the strain energy can exhibit the effect of suppressing dislocation from occurring in the interior of the B1-type solid solution phase 4, thereby suppressing the cracks from being further progressed. That is, when a strong impact is exerted on the cemented carbide 1 during cutting, the tungsten carbide phase 2 having a lower hardness than the B1-type solid solution phase 4 may be broken and cracks may be generated therefrom. However, the B1-type solid solution phase 4 having high hardness and high strength suppresses the propagation of the cracks, so that the deformation of the whole of the cemented carbide 1 can be inhibited to increase the plastic deformation resistance.

Consequently, even in severe cutting conditions where a impact is exerted under a high load in high-speed and strong interrupted cutting, the cutting edge of the cutting tool is free from plastic deformation, and hence the cutting edge has no shear drop, enabling excellent cutting.

On the other hand, when the oxygen contained in the B1-type solid solution phase 4 is less than 1 atomic %, the effect of exerting strain on the crystal lattice is small, failing to suppress the propagation of the cracks caused by the fracture of the tungsten carbide particles 2. As the result, the B1-type solid solution phase 4 is also broken, and plastic deformation resistance cannot be improved. When the oxygen contained in the B1-type solid solution phase 4 is more than 4 atomic %, titanium, niobium, tantalum, tungsten, zirconium or the like, each being component of the B1-type solid solution phase 4, binds excess oxygen and some oxide may be consisted. Therefore, the strength and hardness of the B1-type solid solution phase 4 are lowered and its plastic deformation resistance is lowered.

When the amount of oxygen contained in the whole of the cemented carbide 1 is less than 0.01 mass %, the amount of oxygen contained in the B1-type solid solution phase 4 is insufficient, failing to strengthen the B1-type solid solution phase 4. When the amount of oxygen contained in the whole of the cemented carbide 1 is more than 0.08 mass %, the transverse rupture strength of the cemented carbide 1 is lowered and its wear resistance is lowered.

When measuring the amount of oxygen contained in the B1-type solid solution phase 4 of the cemented carbide 1, Auger electron spectroscopy (AES), or the elementary analysis by transmission electron microscope (TEM) is used to perform point analysis for arbitrary three points for each of the B1-type solid solution phases 4, and the average value is employed as the amount of oxygen of each B1-type solid solution phase 4. Further, the amount of oxygen amount of arbitrarily five B1-type solid solution phases 4 are analyzed in the same manner, and the average value is calculated as the amount of oxygen contained in the B1-type solid solution phase 4 of the cemented carbide 1. The amount of oxygen contained in the whole of the cemented carbide 1 is determined as follows. That is, by infrared absorption, powder samples for arbitrary three measurements are manufactured from the milled powder of the cemented carbide 1, and the average value of the three measurements is employed as the amount of oxygen of the cemented carbide. The average value of the three cemented carbide samples measured in the same manner is calculated as the amount of the cemented carbide 1.

Preferably, the B1-type solid solution phase 4 is present at a rate of 10 to 40 area % in a visual field region of 30d×30d, where "d" is a mean particle size of the above tungsten carbide phase in the structure observation of the above cemented carbide. This ensures that the cracks caused by the fracture of the tungsten carbide phase 2 strike the B1-type solid solution phase 4 and the propagation of the cracks is stopped to improve the plastic deformation resistance of the cemented carbide 1. When the B1-type solid solution phase 4 is present more than 10 area % or more, the abundance of the B1-type solid solution phase 4 is high. This increases the possibility that the cracks caused by the fracture of the tungsten carbide phase 2 strike the B1-type solid solution phase 4, ensuring the stop of the propagation of the cracks. When the B1-type solid solution phase 4 is present 40 area % or less, a lowering of strength can be inhibited with no drop in strength, thus leading to the cemented carbide 1 being excellent in both plastic deformation resistance and strength.

Preferably, the B1-type solid solution phase 4 contains at least niobium (Nb) and tantalum (Ta), and has a cored structure in which the outer periphery of a core member 4*a* having a Nb/Ta of 3.0 to 8.0 is surrounded by a shell member 4*b* having a Nb/Ta of 0 to 2.5, where Nb/Ta is the ratio of niobium (Nb) to tantalum (Ta). This is the structure in which the outer periphery of the core member 4*a* containing much niobium and having superior high-temperature hardness is covered with the shell member 4*b* containing much tantalum and having superior oxidation resistance. Accordingly, the B1-type solid solution phase 4 has a high hardness at high temperature and has excellent oxidation resistance. Even if the cutting edge is heated during cutting, the shell member 4*b* having excellent oxidation resistance can suppress oxidation of the B1-type solid solution phase 4. As the result, the plastic deformation resistance at high temperature of the B1-type solid solution phase 4 can be further improved with no deterioration of the core member 4*a* having excellent high-temperature hardness.

When the Nb/Ta of the core member 4*a* is 3.0 or more, the high-temperature hardness is high. When the Nb/Ta of the core member 4*a* is 8.0 or less, there is no extreme difference between the abundance of tantalum in the core member 4*a* and that in the shell member 4*b*. This achieves a well balance of excellent high-temperature hardness and excellent oxidation resistance. When the Nb/Ta of the shell member 4*b* is 2.5 or less, a large amount of tantalum is present in the shell member 4*b* and hence the oxidation resistance of the shell member 4*b* can be improved. This is preferable to suppress that due to oxygenation during high-temperature cutting, the core member 4*a* having excellent high-temperature hardness is oxidized and the hardness of the B1-type solid solution phase 4 is lowered.

To confirm whether the B1-type solid solution phase 4 of the cemented carbide 1 has a cored structure or not, the cross-sectional structure of the mirror-finished cemented carbide 1 is observed by the backscattered electron image (BEI) of a scanning electron microscope (SEM). Specifically, the presence of the cored structure consisting of the core member 4*a* and the shell member 4*b* can be confirmed by checking whether each B1-type solid solution phase 4 to be observed has a uniform color tone. Here, the core member 4*a* looks darker than the shell member 4*b*. This is because the mass of the element constituting the core member 4*a* is smaller than the mass of the element constituting the shell member 4*b*. To calculate the Nb/Ta in the core member 4*a* and in the shell member 4*b* when the two parts constitute the cored structure, the point analysis by Auger electron spectroscopy (AES) can be used to determine the contents of niobium (Nb) element and tantalum (Ta) element.

<Manufacturing Method>

A manufacturing method of the above-mentioned cemented carbide 1 will be described below. Firstly, to a WC powder, 5.0 to 15.0 mass % of metal Co powder; 0.8 to 4.5 mass % of a niobium carbide powder and 0.5 to 1.5 mass % of a tantalum carbide powder as the compound powders for comprised a B1-type solid solution phase; and 14.0 mass % or less of a compound powder for consist other B1-type solid solution phase are added and mixed. The niobium carbide powder being the compound raw material powder for consist the B1-type solid solution phase has a mean particle size of 0.4 to 0.7 μm.

A solvent is added to the above mixed powder, and this is mixed and milled for a predetermined time, thereby obtaining slurry. To the slurry, a binder is added and mixed further, and the granulation of the mixed powder is carried out while drying the slurry with a spray drier or the like. Subsequently, the formed granules are formed in the shape of a cutting tool by pressing. After degreasing at a furnace, the temperature of the furnace is raised to 1100 to 1300° C., preferably 1100 to 1250° C., and the furnace is retained at the temperature of 1100 to 1250° C. for 1 to 2 hours. Thereafter, the temperature of the furnace is raised to a sintering temperature of 1450 to 1550° C. The cemented carbide 1 can be manufactured by sintering at 1450 to 1550° C. for 1 to 1.5 hours.

In the above manufacturing step, when the particle size of the primary raw material of the niobium carbide powder used as the raw material is smaller than 0.4 μm, the surface area per unit volume is increased, and the amount of adsorbing oxygen is increased. As the result, the amount of oxygen contained in the B1-type solid solution phase tends to increase. When the particle size of the primary raw material of the niobium carbide powder is larger than 0.7 μm, the amount of oxygen contained in the B1-type solid solution phase tends to decrease. In either case, the amount of oxygen contained in the B1-type solid solution phase cannot be controlled to 1 to 4 atomic %.

By retaining at 1100 to 1300° C. for 1 to 2 hours during the sintering, the oxygen adsorbed by the niobium carbide powder can be contained in the B1-type solid solution phase at a rate of 1 to 4 atomic %. If not retained at 1100 to 1300° C., the oxygen adsorbed by the niobium carbide cannot be changed to bound oxygen, and the oxygen content in the B1-type solid solution phase is less than 1 mass %. When the retention temperature is 1100° C. or below, the oxygen adsorbed has no bonding in the B1-type solid solution phase and is exhausted as carbon monoxide. When the retention temperature is 1250° C. or above, the sintering of the cemented carbide may be started. Therefore, a predetermined amount of oxygen cannot be contained in the B1-type solid solution phase, and adsorption oxygen is reacted with carbon and then exhausted as carbon monoxide. Hence, the retention temperature of 1100° C. to 1250° C. is most preferable to admit adsorption oxygen into the B1-type solid solution phase.

When the retention at 1100 to 1300° C. is less than 1 hour, adsorption oxygen cannot be sufficiently changed to bound oxygen, making it difficult to admit a predetermined amount of oxygen into the B1-type solid solution phase. When the retention time exceeds 2 hours, the content of adsorption oxygen in the sintered body is too large, and the amount of oxygen contained in the B1-type solid solution phase is liable to exceed 4 atomic %. Hence, the retention time of 1 to 2 hours is most preferable to admit 1 to 4 atomic % of oxygen into the B1-type solid solution phase.

When retaining at 1100° C. to 1300° C. for 1 to 2 hours before sintering, the oxygen existing in the formed body binds niobium and it is also reacted with carbon and then exhausted as carbon monoxide or carbon dioxide gas. It is therefore possible to reduce the amount of oxygen contained in the whole of the cemented carbide to 0.01 to 0.08 mass %.

The B1-type solid solution phase can surely have the cored structure by mixing the raw material powders for cinsist the B1-type solid solution phase in the following composition of: 0.2 to 4.0 mass % of titanium carbide (TiC); 0.5 to 1.5 mass % of tantalum carbide (TaC); 0.1 to 0.6 mass % of zirconium carbide (ZrC); and 0.8 to 4.5 mass % of niobium carbide (NbC). Particularly, there is a high possibility of consist the cored structure when 0.8<NbC/TaC<10.0, where NbC/TaC is a ratio of NbC to TaC when mixing these. In the range of 0.8<NbC/TaC<10.0, the amounts of addition of NbC and TaC are appropriate, and the B1-type solid solution phase can have the cored structure. Although the detail thereof is unclear, it can be considered as follows. That is, in the process of consist the B1-type solid solution phase, the cobalt that consists a binder phase during sintering is changed to a liquid phase, and the compound powder for consist the B1-type solid solution phase consists a solid solution phase when it is dissolved in the melted binder phase and deposited again, and hence there may be the influence of the change in the solubility of the dissolved compound powder when it is deposited again. Specifically, the concentrations of NbC and TaC dissolved in the melted binder phase when consisting the core member are different from those when consisting the shell member. Therefore, it can be considered that more Nb is present in the core member than the shell member because the concentration of NbC is high when consisting the core member, and more Ta is present in the shell member than the core member because the concentration of Ta is high when consist the shell member.

Then, in the manufactured cemented carbide 1, its surface is polished and a cutting edge part is subjected to honing, if desired.

Further, if desired, a cutting tool may be manufactured by comprising a known hard coating layer on the surface of the cemented carbide 1 by chemical vapor deposition (CVD) method or physical vapor deposition (PVD) method. Especially when deposited by CVD method, no plastic deformation occurs in a substrate composed of the cemented carbide. Consequently, there is no likelihood that the hard coating layer cannot follow the plastic deformation amount of the substrate composed of the cemented carbide, causing peeling from the interface between the cemented carbide and the hard coating layer. This provides excellent wear resistance and excellent fracture resistance.

<Manufacturing Method of Cutting Piece >

Figure 2:
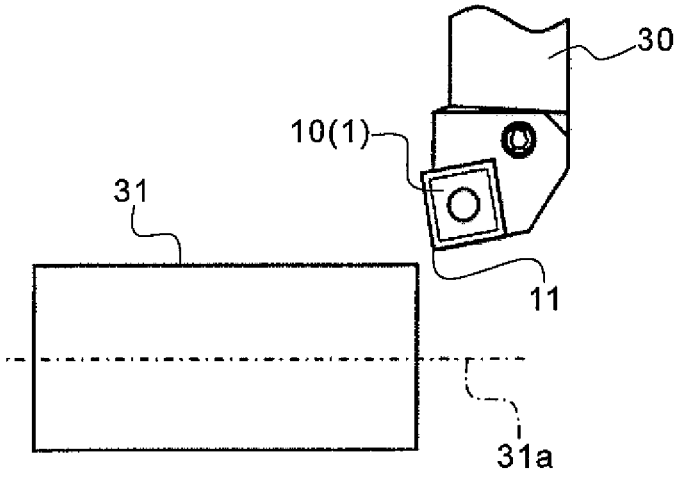
FIG. 2 is an explanatory drawing showing an example of a method of manufacturing a cutting piece according to the present invention.
Figure 3:
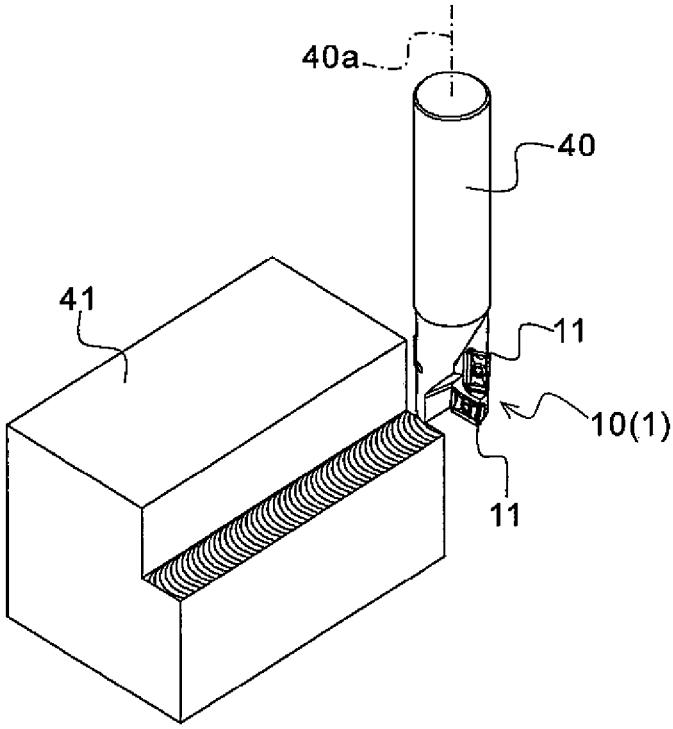
FIG. 3 is a perspective view showing other example of the method of manufacturing a cutting piece according to the present invention.

A method of manufacturing a cutting piece according to the present invention will be described in detail with reference to the accompanying drawings. FIG. 2 is an explanatory drawing showing an example of a method of manufacturing a cutting piece according to the present invention. FIG. 3 is a perspective view showing other example of the method of manufacturing a cutting piece according to the present invention. In FIGS. 2 and 3, the same reference numerals have been used for the same components as in FIG. 1, with the description thereof omitted.

The method of manufacturing a cutting piece in the present invention is a method of obtaining a cutting piece by cuttinging a work material with a cutting tool composed of the above-mentioned cemented carbide 1.

Specifically, the method of manufacturing a cutting piece according to the present invention includes the step of bringing a cutting edge formed at a cross-ridge portion of a rake face and a flank face in the above-mentioned cutting tool, into contact with a surface of a work material; the step of cutting the work material by rotating either the cutting edge or the cutting material; and the step of separating the cutting edge from the surface of the cutting material.

As a specific cutting method, there are, for example, turning operation where a work material is rotated, and milling operation where a cutting toll is rotated.

Specifically, in the turning operation, as shown in FIG. 2, a cutting tool 10 composed of the cemented carbide is fixed to a holder 30, and a work material 31 is rotated about an axis 31*a* of the work material 31. While bringing a cutting edge 11 of the cutting tool 10 into contact with the surface of the work material 31, the work material 31 and the cutting edge 10 are relatively moved to cut the work material 31 in the desired shape, thereby obtaining the desired cutting piece.

On the other hand, in the milling operation, as shown in FIG. 3, the cutting tool 10 is fixed to a holder 40 and rotated about an axis 40*a* of the holder 40. While bringing the cutting edge 11 of the cutting tool 10 into contact with the surface of the work material 41, a work material 41 and the cutting edge II are relatively moved to cut the work material 41 in the desired shape, thereby obtaining the desired cutting piece.

In either operation method, the cutting tool 10 is comprised of the cemented carbide 1, so that excellent wear resistance and fracture resistance can be exhibited thereby to stably provide the cutting piece having a good cutting surface.

Examples of the present invention will be described below. It is understood, however, that the examples are for the purpose of illustration and the invention is not to be regarded as limited to any of the specific materials or condition therein.

EXAMPLES

Examples

<Manufacture of Cutting Tool>

First, a WC powder and a metal Co powder, each having the mean particle size as shown in Table 1, and a compound powder as shown in Table 1 were mixed at the rate as shown in Table 1. Water was added thereto and mixed and milled, and then a shape-keeping additive was then added and further mixed to obtain slurry. The slurry was put in a spray drier, thereby manufacturing a granulated powder. In Table 1, the value with parentheses in the blending composition column is the mean particle size of the primary raw material, the unit of which is μm.

The granulated powder was used to form in a cutting tool shape (CNMG120408) by pressing. After degreasing in a furnace at 450° C. for 1 hour, this was retained at the temperature and for the time as shown in Table 1, followed by heat treatment before sintering. After the heat treatment, under the conditions as shown in Table 1 (the maximum temperature and the retention time), sintering was carried out to manufacture a cemented carbide. With regard to Sample No. 11, sintering was carried out in hydrogen.

Subsequently, both main surfaces of the cemented carbide in a substantially plate shape of the above CNMG120408 were polished, and a cutting edge part was subjected to honing. On the surface of the honed cemented carbide, a titanium nitride (TiN) film of 0.5 μm, a titanium carbide (TiCN) film of 5.0 μm having a columnar crystal structure, an α-type aluminium oxide ($Al_2O_3$) film of 2.0 μm, and a titanium nitride (TiN) film of 1.0 μm were deposited in sequence by chemical vapor deposition (CVD) method.

With respect to the obtained cutting tool, the amount of oxygen was measured three times for each of three sintered bodies by infrared absorption method, and the measured values were employed as the amount of oxygen of the sintered body. The average value of the three sintered bodies was calculated as the amount of oxygen of the cemented carbide. With a scanning electron microscope (SEM) accompanied by Auger electron spectroscopy (AES), the micro structure state of the cemented carbide subjected to mirror-finish polishing was observed, and the amount of oxygen contained in the B1-type solid solution phase was measured by Auger electron spectroscopy (AES). The cross-sectional structure of the mirror-finished cemented carbide 1 was observed by the back-scattered electron image (BEI) of the scanning electron microscope (SEM). As to whether the cored structure consisting of the cored member and the shell member was consisted or not was confirmed by checking whether each of the observed B1-type solid solution phase was of uniform color tone. With respect to the sample where the B1-type solid solution phase had the cored structure, arbitrary three points of the core member and arbitrary three points of the shell member were measured by Auger electron spectroscopy. With respect to the sample having no cored structure, arbitrary three points of the B1-type solid solution phase were measured. Arbitrary five B1-type solid solution phase were measured to obtain an average value.

A photograph of the mirror-finish polished surface of the cemented carbide was taken at a magnification of ×3000 by the scanning electron microscope. The image analysis of this photograph was performed by a "LUZEX," to calculate the area % of the B1-type solid solution phase. Specifically, the average value of arbitrary three points was employed as the area % of the B1-type solid solution phase contained in the cemented carbide.

The results are shown in Table 2. In Table 2, the presence of two figures in the columns of the B1-type solid solution phase indicates the samples having the core structure. That is, the figure on the upper side indicates the oxygen content in the shell member, and the figure on the lower side indicates the measured value of the oxygen content in the core member. On the other hand, the presence of a figure in the columns of the B1-type solid solution phase indicates the samples having no cored structure, and the figure is the measured value at the center of the B1-type solid solution phase.

TABLE 1

| Sample | Blending composition(mass %)*1 | | | | | | | Heat treatment | | Sintering | |
|---|---|---|---|---|---|---|---|---|---|---|---|
| | | | | | | | | Temperature | Time | Maximum temperature | Retention time |
| No. | WC | Co | TiC | TiN | TaC | ZrC | NbC | (° C.) | (hr) | (° C.) | (hr) |
| 1 | 86.3 (8.5) | 9 (1.3) | 1.3 (1.0) | — | 1.5 (1.3) | 0.5 (2) | 1.4 (0.50) | 1200 | 1 | 1450 | 1 |
| 2 | 85.6 (9) | 8 (1.4) | 2 (1.1) | — | 2 (1.2) | 0.4 (2.2) | 2 (0.60) | 1250 | 1.5 | 1500 | 1.2 |
| 3 | 90 (8.8) | 8 (1.5) | 0.4 (1.3) | — | 0.5 (1.1) | 0.3 (2.4) | 0.8 (0.45) | 1200 | 1 | 1550 | 1 |
| 4 | 83.9 (8.6) | 8.5 (1.2) | 0.5 (1.1) | — | 5 (1.4) | 0.5 (2) | 1.6 (0.52) | 1100 | 2 | 1450 | 1.4 |
| 5 | 85 (9.2) | 8.5 (1.3) | 1.7 (1) | — | 2 (1.2) | 0.3 (2.6) | 2.5 (0.65) | 1250 | 1 | 1500 | 1.2 |
| 6 | 85.7 (8.5) | 7.8 (1.5) | 0.2 (1.1) | — | 4.5 (1.4) | 0.4 (2.2) | 1.4 (0.7) | 1200 | 1.5 | 1500 | 1.4 |
| 7 | 84.3 (8.7) | 8.5 (1.4) | 3 (0.9) | — | 1.5 (1.3) | 0.5 (2) | 2.2 (0.4) | 1150 | 1 | 1530 | 1 |
| *8 | 84.5 (8.8) | 10 (1.5) | 2.5 (1.2) | — | 1.1 (1.2) | 0.6 (1.9) | 1.3 (1.2) | 1200 | 1 | 1450 | 1.2 |
| *9 | 85.2 (8.5) | 8.8 (1.3) | 1 (1.1) | — | 4 (1.2) | 0.5 (2) | 0.5 (0.55) | 900 | 1 | 1500 | 1.4 |
| *10 | 89.2 (8.9) | 8.2 (1.2) | 0.5 (1) | — | 1 (1.5) | 0.3 (2.3) | 0.8 (0.5) | 1300 | 1 | 1500 | 1 |
| *11 | 87.2 (1.5) | 8.8 (1.4) | 1.0 (1.2) | — | 2 (1.3) | 0.3 (1.3) | 0.3 (1.3) | — | — | 1520 | 1 |
| 12 | 84.7 (9.1) | 8.5 (1.3) | — | 0.6 (1.0) | 4 (1.2) | 0.4 (2.4) | 1.8 (0.63) | — | — | 1500 | 1.2 |

Samples marked "*" are out of the scope of the present invention.

*1The value with parentheses in the blending composition column is the mean particle size of the primary raw material, the unit of which is μm.

TABLE 2

| Sample No. | Sintered body | B1-type solid solution phase | | | | |
|---|---|---|---|---|---|---|
| | Amount of oxygen (mass %) | Cored structure | Amount of oxygen*2 (atomic %) | Area % | Core member Nb/Ta | Shell member Nb/Ta |
| 1 | 0.03 | Exist | 1.1<br>2.0 | 21 | 6.50 | 1.5 |
| 2 | 0.05 | Exist | 1.2<br>4.0 | 28 | 6.5 | 1.3 |
| 3 | 0.08 | Exist | 1.9<br>2.9 | 10 | 8 | 2.5 |
| 4 | 0.03 | No exist | 2.2 | 24 | 3 | — |

TABLE 2-continued

| Sample No. | Sintered body Amount of oxygen (mass %) | B1-type solid solution phase Cored structure | Amount of oxygen*2 (atomic %) | Area % | Core member Nb/Ta | Shell member Nb/Ta |
|---|---|---|---|---|---|---|
| 5 | 0.02 | Exist | 1.5<br>3.0 | 32 | 7 | 1.5 |
| 6 | 0.01 | No exist | 1.3 | 15 | 3.5 | — |
| 7 | 0.06 | Exist | 1.8<br>3.8 | 40 | 7.5 | 2.3 |
| *8 | 0.04 | Exist | <0.1<br><0.1 | 42 | 6.5 | 2 |
| *9 | 0.12 | No exist | <0.1 | 12 | 2 | — |
| *10 | 0.1 | Exist | 7.0<br>5.8 | 8 | 5.5 | 2 |
| *11 | 0.02 | No exist | <0.1 | 23 | 4 | — |
| 12 | 0.04 | No exist | 1.2 | 22 | 4 | — |

Samples marked "*" are out of the scope of the present invention.
*2The presence of two figures in the columns of the B1-type solid solution phase indicates the samples having the core structure. That is, the figure on the upper side indicates the oxygen content in the shell member, and the figure on the lower side indicates the measured value of the oxygen content in the core member.
On the other hand, the presence of a figure in the columns of the B1-type solid solution phase indicates the samples having no cored structure, and the figure is the measured value at the center of the B1-type solid solution phase.

<Evaluations>

Wear resistance and fracture resistance were evaluated by conducting a continuous cutting test (variable depth of cut test) and a strong interrupted cutting test (fracture resistance test) of the cutting tools obtained above under the following conditions. The results are shown in Table 3.

[Continuous Cutting Test (Variable Depth of Cut Test)]

(Cut Variable Cutting Conditions)

work material: SCM435

Tool shape: CNMG120408

Cutting speed: 300 m/min

Feed rate: 0.3 mm/rev

Depth of cut: 1.0 to 3.0 mm (Depth of cut was varied per 3-second cutting)

Cutting time: 35 minutes

Cutting solution: Mixed solution of 15% of emulsion and 85% of water

Evaluation item: By a microscope, the cutting edge was observed to determine the wearing amount of the flank face and evaluate the worn cutting edge state.

[Strong Interrupted Cutting Test (Fracture Resistance Test)]

(Strong Interrupted Cutting Conditions)

work material: SCM440 with four grooves

Tool shape: CNMG120408

Cutting speed: 300 m/min

Feed rate: 0.40 mm/rev

Depth of cut: 2 mm

Cutting solution: Mixed solution of 15% of emulsion and 85% of water

Evaluation item: The number of impacts causing fracture: After 1000 impacts, the cutting edge state was observed by a microscope.

TABLE 3

| Sample No. | wear resistance test Wearing amount of the flank face (mm) | Worn cutting edge state | Fracture resistance test Number of impacts before fracture (times) | Cutting edge state |
|---|---|---|---|---|
| 1 | 0.14 | No plastic deformation | 4500 | No plastic deformation |
| 2 | 0.16 | No plastic deformation | 4200 | No plastic deformation |
| 3 | 0.15 | No plastic deformation | 4100 | No plastic deformation |
| 4 | 0.15 | No plastic deformation | 4400 | No plastic deformation |
| 5 | 0.16 | No plastic deformation | 4300 | No plastic deformation |
| 6 | 0.17 | No plastic deformation | 4400 | No plastic deformation |
| 7 | 0.17 | No plastic deformation | 4350 | No plastic deformation |
| *8 | 0.32 | Plastic deformation | 2500 | Plastic deformation |
| *9 | 0.30 | Cutting edge shear drop<br>Plastic deformation | 2800 | Plastic deformation |
| *10 | 0.25 | Plastic deformation | 2650 | Plastic deformation<br>Film separation |
| *11 | 0.26 | Plastic deformation | 2750 | Plastic deformation<br>Film separation |
| 12 | 0.20 | Small plastic deformation | 3500 | Small plastic deformation |

Samples marked "*" are out of the scope of the present invention.

From the results shown in Tables 1 to 3, Samples Nos. 8, 9, and 11, in which the oxygen content of the B1-type solid solution phase was less than 1 atomic %, had plastic deformation, cutting edge shear drop and film peeling, resulting in poor wear resistance and poor fracture resistance. Sample No. 10, in which the oxygen content of the B1-type solid solution phase exceeded 4 atomic %, was extremely poor in wear resistance, and poor in fracture resistance.

Conversely, Samples Nos. 1 to 7, in which the oxygen content in the cemented carbide was 0.01 to 0.08 mass %, and the oxygen content of the B1-type solid solution phase was less than 1 to 4 atomic %, had no plastic deformation in the cutting at variable depth of cut and in the high-speed strong interrupted cutting, and had a long tool life. These samples had neither peeling nor fracture of the hard coating layer, exhibiting cutting performance of excellent wear resistance and fracture resistance. Sample No. 12 had "small plastic deformation," which was in the range of causing no problem in practical use.

It is further understood by those skilled in the art that the foregoing description is a preferred embodiment of the disclosed cutting tool and that various changes and modifications may be made in the invention without departing from the spirit and scope thereof. Term "mass %" may replace with "weight %".

What is claimed is:

1. A cutting tool comprising a cemented carbide, a composition of the cemented carbide comprising:

5.0 to 15.0 mass % of cobalt;

0.8 to 4.5 mass % of niobium in terms of carbide;

0.5 to 16.0 mass % of at least one selected from carbide (except for tungsten carbide), nitride, and carbon nitride which are selected from the group consisting of metals of the groups IV, V, and VI in the periodic table, except for niobium;

0.01 to 0.08 mass % of oxygen; and the rest consisted of tungsten carbide and unavoidable impurities, the cemented carbide comprising a structure in which a tungsten carbide phase and a B1-type solid solution phase being expressed by M(CNO) or M(CO) where "M" is at least one selected from the group consisting of the group IV, V, and VI in the periodic table, containing niobium as being essential, and containing oxygen at a rate of 1 to 4 atomic % are bound by a binder phase composed mainly of the cobalt.

2. The cutting tool according to claim 1, wherein the B1-type solid solution phase is present at a rate of 10 to 40 area % in a visual field region of 30d×30d, where "d" is a mean particle size of the above tungsten carbide phase in a structure observation of the cemented carbide.

3. The cutting tool according to claim 1, wherein the B1-type solid solution phase contains at least niobium (Nb) and tantalum (Ta), and has a cored structure in which an outer periphery of a core member having a Nb/Ta of 3.0 to 8.0 is surrounded by a shell member having a Nb/Ta of 0 to 2.5, where Nb/Ta is a ratio of niobium (Nb) to tantalum (Ta).

4. A method of manufacturing a cutting piece comprising:

the step of bringing a cutting edge formed at a cross-ridge portion of a rake face and a flank face in claim 1 cutting tool, into contact with a surface of a work material;

the step of cutting the work material by rotating either the cutting edge or the work material; and the step of separating the cutting edge from a surface of the work material.

* * * * *